United States Patent [19]

Edwards et al.

[11] 4,306,676

[45] Dec. 22, 1981

[54] TUBE HOLDER FOR CENTRIFUGE ROTOR

[75] Inventors: John R. Edwards, Mountain View; Francis D. Richards, Sunnyvale, both of Calif.

[73] Assignee: Beckman Instruments, Inc., Fullerton, Calif.

[21] Appl. No.: 141,247

[22] Filed: Apr. 17, 1980

[51] Int. Cl.[3] ..... B04B 15/00; B04B 9/12

[52] U.S. Cl. ..... 233/26

[58] Field of Search ..... 233/26, 23 R, 23 A, 233/1 A

[56] References Cited

U.S. PATENT DOCUMENTS

| | | | |
|---|---|---|---|
| 3,050,239 | 8/1962 | Williams | 233/26 |
| 3,674,198 | 7/1972 | Eberle | 233/26 |
| 3,891,140 | 6/1975 | Ayres | 233/26 |
| 3,905,772 | 9/1975 | Hartnett | 233/26 |
| 4,032,066 | 6/1977 | Wright | 233/26 |
| 4,068,798 | 1/1978 | Rohde | 233/26 |
| 4,141,489 | 2/1979 | Wright | 233/26 |

*Primary Examiner*—Robert W. Jenkins

*Attorney, Agent, or Firm*—R. J. Steinmeyer; F. L. Mehlhoff; R. J. Stern

[57] ABSTRACT

A test tube holder for insertion into a cylindrical test tube cavity in a centrifuge rotor to support a plurality of relatively small test tubes within the rotor cavity. The holder includes a body whose shape is substantially that of a cylinder or a longitudinal section thereof. The body has a plurality of small cavities for holding test tubes, the smaller cavities being spaced apart in a direction along the longitudinal dimension of the body. Each of the smaller cavities is arranged at an angle relative to the longitudinal dimension of the body, and each has a mouth opening onto an exterior surface of the body. The test tube holder further includes means for orienting the holder in the centrifuge rotor test tube cavity so that the mouths of the smaller cavities face the rotational axis of the centrifuge rotor when the test tube holder is inserted into said centrifuge rotor test tube cavity.

9 Claims, 3 Drawing Figures

TUBE HOLDER FOR CENTRIFUGE ROTOR

BACKGROUND OF THE INVENTION

1. Field of the Invention

The invention relates to means for holding test tubes in a centrifuge rotor and, more particularly, to means for holding a plurality of small test tubes in a single cylindrical cavity in the rotor.

2. Description of the Prior Art

Centrifuge rotors may be classified according to their means for holding test tubes as either fixed angle rotors or swinging bucket/swinging rack rotors. Fixed angle rotors have bored therein a plurality of uniformly circumferentially spaced cylindrical cavities, each cavity being designed to contain a single test tube. Fixed angle rotors may have the tube cavities bored at various angles with respect to the axis of the rotor, generally ranging from approximately 35° to vertical. Swinging bucket or swinging rack rotors have a plurality of brackets to each of which may be pivotally mounted a test tube bucket or a rack containing one or more test tubes.

Racks and adapters have been developed for swinging bucket and swinging rack rotors which allow a large number of small test tubes to be mounted in a single rack or bucket. Examples are disclosed in U.S. Pat. Nos. 4,032,066 and 4,141,489 issued to Herschel E. Wright and assigned to the same assignee as the present application, and U.S. Pat. No. 4,068,798 issued to Vernon C. Rohde. A given swinging bucket rotor may be adapted to receive test tubes of various sizes and shapes by selecting from an assortment of racks or adapters designed to accommodate the various sizes of test tubes.

However, fixed angle rotors normally are designed to receive only test tubes having substantially the same diameter as the cylindrical cavities bored in that rotor. Although a test tube cavity in a fixed angle rotor may be modified to accept a smaller diameter test tube, no means has been developed heretofore for holding a plurality of small test tubes in a single test tube cavity.

This shortcoming of presently known fixed angle rotors is significant because many modern clinical and research applications involve the use of smaller size samples, and hence smaller test tubes, than had been commonly used in the past. Many existing fixed angle centrifuge rotors are bit enough to accommodate a large number of these smaller test tubes, but have a small number of large test tube cavities instead of a large number of small cavities. Although such a centrifuge rotor could be replaced by one designed to hold a larger number of smaller test tubes, centrifuge rotors are very expensive, and it often would be preferable to adapt an existing rotor to different applications instead of purchasing new rotors.

SUMMARY OF THE INVENTION

The present invention increases the versatility of a fixed angle centrifuge rotor by adapting a rotor designed to receive a relatively small number of relatively large test tubes to accommodate instead a larger number of smaller test tubes.

In particular, the present invention is a test tube holder for insertion into a cylindrical test tube cavity in a centrifuge rotor. The holder includes a body whose shape is substantially that of a cylinder or a longitudinal section thereof. The body has a plurality of small cavities for holding test tubes, the smaller cavities being spaced apart in a direction along the longitudinal dimension of the body. Each of the smaller cavities is arranged at an angle relative to the longitudinal dimension of the body, and each has a mouth opening onto an exterior surface of the body. The test tube holder further includes means for orienting the holder in the centrifuge rotor test tube cavity so that the mouths of the smaller cavities substantially face the rotational axis of the centrifuge rotor when the test tube holder is inserted into said centrifuge rotor test tube cavity.

Some embodiments of the test tube holder additionally include a cover and gasket for enclosing the mouths of the smaller cavities to create an airtight seal. The cover and body combination when fastened together may have a cylindrical shape for insertion into a cylindrical test tube cavity in a centrifuge rotor. A preferred means for fastening the cover to the body comprises a tongue-in-groove arrangement to retain one end of the cover against the body and an L-shaped clamp, pivotally attached to the body, adapted to overlap the outer surface of the cover to fasten the other end of the cover to the body.

In some embodiments of the test tube holder, the orienting means comprises a tab adapted for insertion into an indexing notch in the centrifuge rotor at the top edge of the centrifuge rotor test tube cavity. In embodiments having an L-shaped clamp for fastening the cover to the body, the unattached end of the clamp may serve as this tab.

DESCRIPTION OF THE PREFERRED EMBODIMENTS

Figure 1:
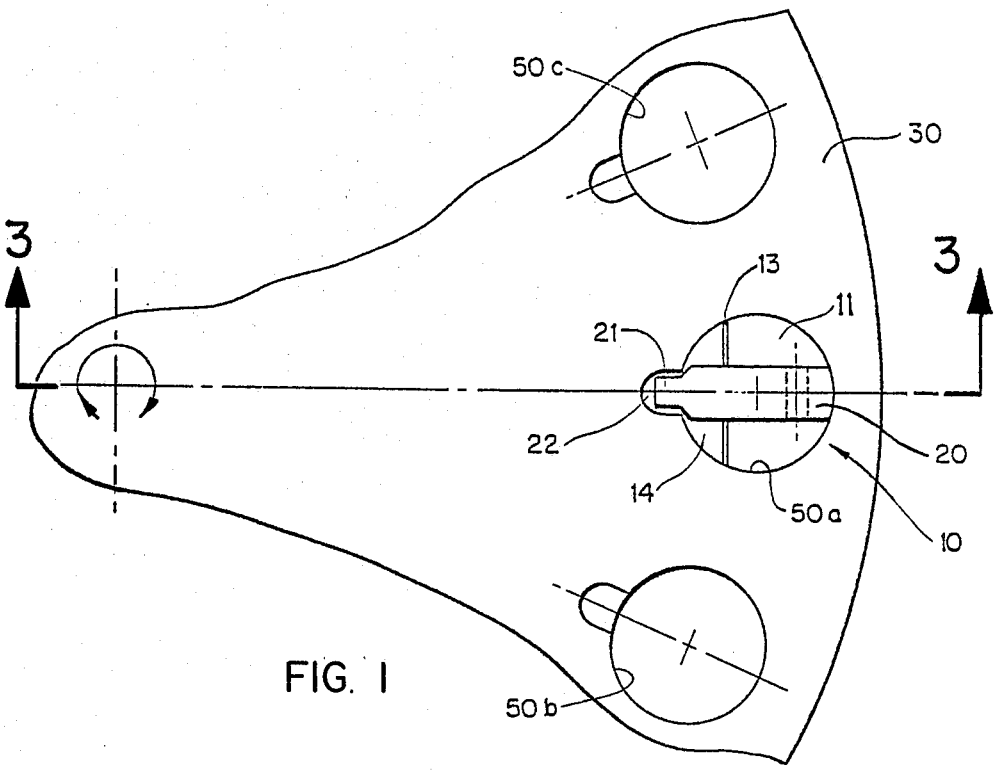
FIG. 1 is a top view of a portion of a centrifuge rotor having several vertical test tube cavities, in one of which is inserted a test tube holder according to the present invention.

FIG. 1 shows a fixed angle centrifuge rotor 30 of the type commonly called a vertical tube rotor. Spaced around its circumference are several vertical cylindrical test tube cavities 50, each of which is designed to contain a single relatively large test tube. Vertical tube cavities **50*b* and 50*c* are illustrated as empty. The remaining vertical tube cavity 50*a* is illustrated as containing a cylindrical test tube holder according to the present invention, shown generally as 10**.

Figure 3:
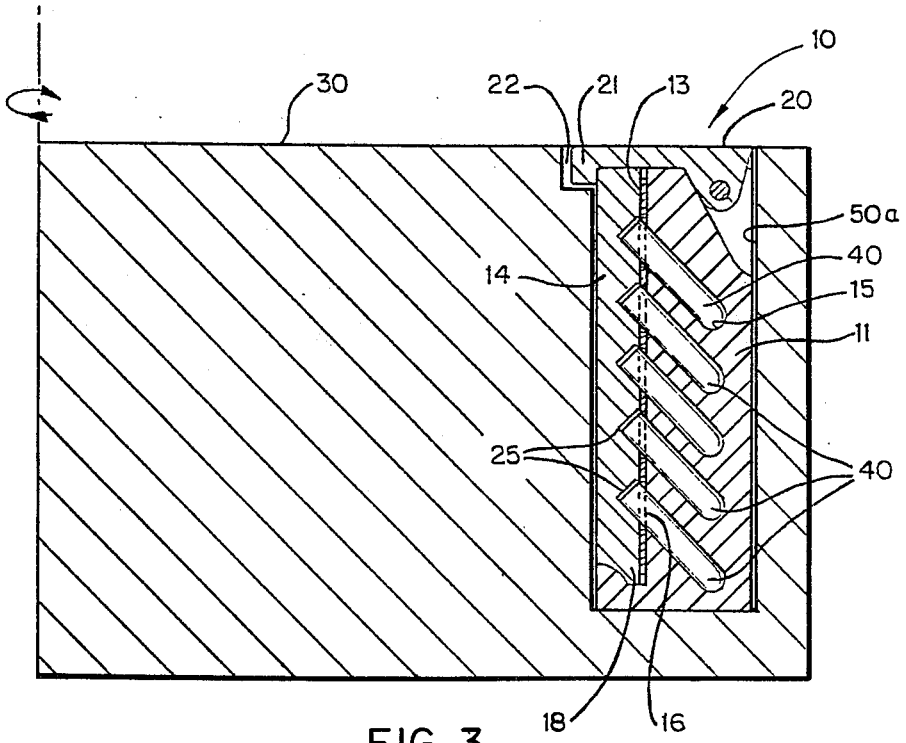
FIG. 3 is a sectional view taken along line 3—3 in FIG. 1, but with the sectional line being offset as shown in FIG. 2 to permit illustration of the small test tube cavities.
Figure 2:
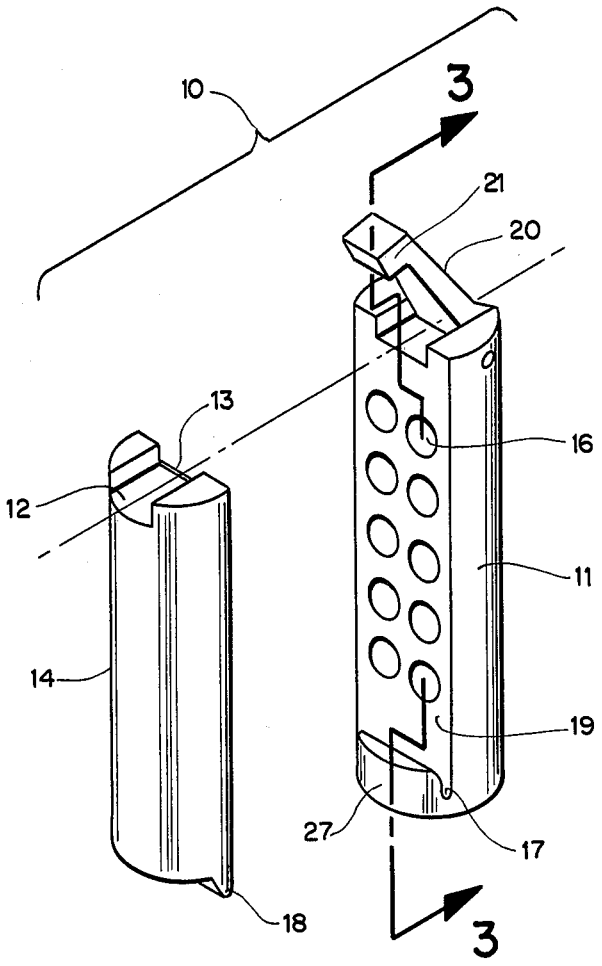
FIG. 2 is an exploded perspective view of a test tube holder according to the present invention.

FIG. 3 illustrates the relative positions of the centrifuge rotor 30, the test tube holder 10, the small cavities 15 within the test tube holder, and the small test tubes 40, one of which is contained in each of the small cavities 15. FIG. 2 shows the test tube holder alone.

The illustrated preferred embodiment of test tube holder 10 has a body 11 in the shape of a longitudinal section of a cylinder having a longitudinal flat surface 19. (See FIGS. 1 and 2.) The test tube holder 10 further includes a cover 14, also in the shape of a longitudinal section of a cylinder having a longitudinal flat surface. The flat surfaces of the cover and body are adapted for mating, as shown in FIGS. 1 and 2, so that the mated cover and body combination has a cylindrical shape.

The body 11 of the test tube holder 10 contains several small cavities 15 for holding small test tubes 40. (The test tubes themselves are shown only in FIG. 3.) The small cavities are stacked vertically to permit holding the largest possible number of test tubes. All the small cavities are the same radial distance from the rotational axis of the centrifuge rotor 30 as that they all experience the same centrifugal force when the rotor rotates.

Each small cavity 15 has a mouth 16 opening to flat surface 19 on the body 11. (See FIG. 3.) A test tube may be inserted into each cavity through its mouth. After the test tubes are inserted into the small cavities, they may be sealed by fastening cover 14 and gasket 13 over flat surface 19.

Cover 14 is fastened to body 11 by first inserting tongue 18 at the lower end of the cover into groove 17 behind retaining lip 27 near the bottom of the body, thereby retaining the lower end of the cover against the body, and then lowering clamp 20, which pivots at the top of the body, so as to fit snugly in groove 12 at the top of the cover. When clamp 20 is lowered, tab 21 at the end of the clamp overlaps the outer surface of cover 14, thereby holding the cover tightly against gasket 13 and body 11.

When fastened to body 11, the cover 14 and gasket 13 form an airtight seal around each individual small cavity. This is important when using the test tube holder in a vacuum centrifuge because the test tubes must be sealed against the centrifuge vacuum. Prior art means for sealing test tubes against the centrifuge vacuum generally require a rotor lid or individual caps for each small cavity, either of which is less convenient than using the cover according to the present invention. Another desirable characteristic of this sealing system is that at high rotor speeds the centrifugal force on the cover increases the compressive force on the gasket, thereby improving, rather than weakening, the quality of the seal.

In the preferred embodiment shown in FIGS. 2 and 3, cover 14 has a plurality of small cavities 25 which, when the cover is fastened to body 11, align with the small cavities 15 in the body to permit the test tube holder to receive test tubes slightly longer than the length of the cavities 15 in the body portion alone. Similarly, gasket 13 has openings aligned with the mouths of cavities 15 and 25. If one expects to use only shorter test tubes, one could fabricate the cover 14 as a solid piece, omitting the cavities 25. In this case, of course, gasket 13 preferably would also be fabricated as a solid piece without openings.

Tab 21 at the end of clamp 20 also serves the function of orienting test tube holder 10 in vertical tube rotor cavity 50. The top of tube cavity 50 includes an indexing notch 22 into which fits tab 21. When the tab is inserted in the notch, test tube holder 10 is correctly oriented about its cylindrical axis so that the mouth 16 of each small cavity 15 faces the center of centrifuge rotor 30.

A readily appreciated advantage of the invention is its ease and speed of use. The simple procedure is to insert a number of test tubes into the small cavities in the body, place the cover (and gasket) over the body, slide the clamp over the cover to lock it in place, and lower the assembly into a vertical test tube cavity in the centrifuge rotor.

Although the invention has been described in an embodiment designed for insertion in a centrifuge rotor having vertical test tube cavities, the invention is also useful with rotors having angled test tube cavities. In this latter application, it probably would be desirable to construct the tube holder so as to have a smaller angle between each small cavity and the axis of the tube holder.

We claim:

1. A test tube holder for insertion into a cylindrical test tube cavity in a centrifuge rotor, comprising a substantially cylindrical body having therein a plurality of smaller cavities for holding test tubes, each of the smaller cavities being oriented at an angle to the longitudinal dimension of the body, each smaller cavity being completely enclosed within the body except for having a mouth opening onto a longitudinal exterior surface of the body, and the smaller cavities being spaced apart in a direction along the longitudinal dimension of the body; and means for orienting the test tube holder in the centrifuge rotor test tube cavity so that the mouths of the smaller cavities substantially face the rotational axis of the centrifuge rotor when the test tube holder is inserted into the centrifuge rotor test tube cavity.

2. A test tube holder according to claim 1, further comprising a cover adapted for placement over said exterior surface of the body in such a way as to cover the mouths of the smaller cavities; and means for fastening the cover to the body.

3. A test tube holder for insertion into a cylindrical test tube cavity in a centrifuge rotor, comprising a body in the shape of a longitudinal section of a cylinder having a longitudinal flat surface and having a plurality of smaller cavities for holding test tubes, the smaller cavities being spaced apart along the longitudinal dimension of the body, each smaller cavity being oriented at an angle to the longitudinal dimension of the body, and each smaller cavity being completely enclosed within the body except for having a mouth opening to the longitudinal flat surface; and means for orienting the test tube cavity so that the mouths of the smaller cavities substantially face the rotational axis of the centrifuge rotor when the test tube holder is inserted into the centrifuge rotor test tube cavity.

4. A test tube holder according to claim 3, further comprising a cover in the shape of a longitudinal section of a cylinder having a longitudinal flat surface, the longitudinal flat surface of the cover being adapted for mating with the longitudinal flat surface of the body in such a way that the mated cover and body combination has a cylindrical shape with the cover enclosing the mouths of the smaller cavities in the body; and means for fastening the cover to the body.

5. A test tube holder according to claim 2 or 4, further comprising a sealing gasket adapted for placement between the cover and the body to provide an airtight seal around the smaller cavities when the cover is fastened to the body.

6. A test tube holder according to claim 5, wherein an individual airtight seal is formed around each of the smaller cavities when the cover is fastened to the body.

7. A test tube holder for insertion into a cylindrical test tube cavity in a centrifuge rotor, comprising a body in the shape of a longitudinal section of a cylinder having a longitudinal flat surface and having a plurality of smaller cavities for holding test tubes, the smaller cavities being spaced apart along the longitudinal dimension of the body, each smaller cavity being oriented at an angle to the longitudinal dimension of the body, and each smaller cavity having a mouth opening to the longitudinal flat surface;

a cover in the shape of a longitudinal section of a cylinder having a longitudinal flat surface, the longitudinal flat surface of the cover being adapted for mating with the longitudinal flat surface of the body in such a way that the mated cover and body combination has a cylindrical shape with the cover enclosing the mouths of the smaller cavities in the body;

means for fastening the cover to the body; and orienting means, comprising a tab adapted for insertion into an indexing notch in the centrifuge rotor at the top edge of the centrifuge rotor test tube cavity, for orienting the test tube holder in the centrifuge rotor test tube cavity so that the mouths of the smaller cavities substantially face the rotational axis of the centrifuge rotor when the test tube holder is inserted into the centrifuge rotor test tube cavity.

8. A test tube holder for insertion into a cylindrical test tube cavity in a centrifuge rotor, comprising a body in the shape of a longitudinal section of a cylinder having a longitudinal flat surface and having a plurality of smaller cavities for holding test tubes, the smaller cavities being spaced apart along the longitudinal dimension of the body, each smaller cavity being oriented at an angle to the longitudinal dimension of the body, and each smaller cavity having a mouth opening to the longitudinal flat surface;

means for orienting the test tube holder in the centrifuge rotor test tube cavity so that the mouths of the smaller cavities substantially face the rotational axis of the centrifuge rotor when the test tube holder is inserted into the centrifuge rotor test tube cavity;

a cover in the shape of a longitudinal section of a cylinder having a longitudinal flat surface, the longitudinal flat surface of the cover being adapted for mating with the longitudinal flat surface of the body in such a way that the mated cover and body combination has a cylindrical shape with the cover enclosing the mouths of the smaller cavities in the body; and means for fastening the cover to the body comprising a retaining lip attached to the body and extending above one end of the longitudinal flat surface thereof so as to leave a groove-shaped space between the retaining lip and the body;

a tongue extending from one end of the cover, the tongue being adapted for insertion in the groove-shaped space so as to retain said end of the cover against the body; and an L-shaped clamp pivotally attached at one of its ends to the end of the body opposite that from which the lip extends, the clamp being adapted to overlap the outer surface of the cover and fasten the cover to the body.

9. A test tube holder according to claim 8, wherein the means for orienting the test tube holder comprises the unattached end of the clamp, said unattached end being adapted for insertion into an indexing notch in the centrifuge rotor at the top edge of the centrifuge rotor test tube cavity.

* * * * *